US010524519B2

(12) United States Patent
Deal et al.

(10) Patent No.: US 10,524,519 B2
(45) Date of Patent: Jan. 7, 2020

(54) ADHESIVE BRA CONSTRUCTION INCLUDING VERTICAL SUPPORT STRAP

(71) Applicants: Beverly Ann Deal, Austin, TX (US); Rebecca Harmon, Austin, TX (US); Chih Jung Lee, Austin, TX (US); Judy Lee, Austin, TX (US); Kevin Lee, Monterey Park, CA (US)

(72) Inventors: Beverly Ann Deal, Austin, TX (US); Rebecca Harmon, Austin, TX (US); Chih Jung Lee, Austin, TX (US); Judy Lee, Austin, TX (US); Kevin Lee, Monterey Park, CA (US)

(73) Assignee: Ce Soir Lingerie Company, Inc., Austin, TX (US)

( * ) Notice: Subject to any disclaimer, the term of this patent is extended or adjusted under 35 U.S.C. 154(b) by 149 days.

(21) Appl. No.: 15/675,375

(22) Filed: Aug. 11, 2017

(65) Prior Publication Data

US 2018/0140024 A1 May 24, 2018

Related U.S. Application Data

(60) Provisional application No. 62/426,150, filed on Nov. 23, 2016.

(51) Int. Cl.

| | |
|---|---|
| ***A41C 3/00*** | (2006.01) |
| ***A41C 3/06*** | (2006.01) |
| *A41C 3/12* | (2006.01) |

(52) U.S. Cl.

CPC ..... *A41C 3/065* (2013.01); *A41C 3/0007* (2013.01); *A41C 3/128* (2013.01)

(58) Field of Classification Search

CPC ..... A41C 3/00; A41C 3/065; A41C 3/0007; A41C 3/0128

USPC ..... 450/81, 88, 37, 54–58

See application file for complete search history.

(56) References Cited

U.S. PATENT DOCUMENTS

| | | | | |
|---|---|---|---|---|
| 2,079,426 | A | 5/1937 | Schottenfels | |
| 3,276,449 | A * | 10/1966 | Morgan | A41C 3/065 450/81 |
| 3,401,407 | A | 9/1968 | Pittman | |
| 3,934,593 | A * | 1/1976 | Mellinger | A41C 3/065 428/355 R |
| 4,343,313 | A * | 8/1982 | Le Jeune | A41C 3/065 450/39 |
| 5,693,164 | A | 12/1997 | Chang | |
| 5,755,611 | A * | 5/1998 | Noble | A41C 3/065 450/39 |
| 5,922,023 | A | 7/1999 | Mulligan et al. | |
| 6,036,577 | A | 3/2000 | Coburn | |
| 6,371,831 | B1 | 4/2002 | Dodge | |
| 6,666,747 | B1 * | 12/2003 | Buntz | A41C 3/065 424/400 |
| D485,965 | S * | 2/2004 | Slimak | D2/706 |
| 6,758,720 | B2 * | 7/2004 | Chen | A41C 3/065 2/267 |
| 6,761,614 | B2 | 7/2004 | Pinna | |

(Continued)

*Primary Examiner* — Gloria M Hale

(74) *Attorney, Agent, or Firm* — Arthur Freilich

(57) ABSTRACT

An adhesive bra comprised of left and right breast support members where each support member includes a cup portion and a vertically extending strap. The rear facing surface of the cup and strap carry reusable pressure sensitive adhesive for adhering to a wearer's skin.

9 Claims, 3 Drawing Sheets

(56) References Cited

U.S. PATENT DOCUMENTS

| | | | | |
|---|---|---|---|---|
| 6,780,081 | B2 * | 8/2004 | Chen | A41C 3/065 450/54 |
| 6,852,001 | B2 | 2/2005 | Chen et al. | |
| 6,857,932 | B2 | 2/2005 | Chen | |
| 6,916,224 | B2 | 7/2005 | Chen et al. | |
| 6,921,316 | B1 * | 7/2005 | Jian | A41C 3/105 450/38 |
| 7,278,899 | B2 * | 10/2007 | Davis | A41C 3/065 450/38 |
| 7,566,344 | B2 * | 7/2009 | Hansen | A61F 2/52 450/81 |
| 8,936,504 | B2 * | 1/2015 | Deal | A41C 3/0078 450/39 |
| 9,565,878 | B2 * | 2/2017 | Hernandez | A41C 3/065 |

* cited by examiner

ADHESIVE BRA CONSTRUCTION INCLUDING VERTICAL SUPPORT STRAP

RELATED APPLICATIONS

This application incorporates by reference and claims the benefit of U.S. Provisional Application 62/426,150 filed Nov. 23, 2016.

FIELD OF THE INVENTION

This invention relates generally to women's underclothing and more particularly to a bra construction especially configured for large breasted women for use with plunge and/or backless overgarments.

BACKGROUND OF THE INVENTION

The prior art is replete with bra constructions comprised of separate left and right breast cups. Each breast cup is typically provided with adhesive on its rear facing surface for adhering to, and supporting, a user's breast. In some such designs, each cup is provided with a wing adapted to extend laterally to near or under a user's arm to enhance adhesion area. Although such constructions are often adequate to support smaller breasts (e.g. A, B cups), they are generally inadequate to support larger breasts (e g. D, DD, DDD, G, H cups).

SUMMARY OF THE INVENTION

The present invention is directed to a bra comprised of separate left and right breast support members. Each breast support member is formed of substantially planar material having front and rear facing surfaces forming a cup in the rear facing surface including a concave cavity sized and configured to accommodate a user's breast. The cup rear facing surface, including the surface portions in and around the cavity, carry a reusable pressure sensitive adhesive for adhering to a user's skin. In accordance with a significant aspect of the present invention, each support member also includes an elongate support strap, preferably formed of clear transparent material, extending vertically from an upper region of the cup's periphery. A rear facing surface of the strap also carries a reusable pressure sensitive adhesive for adhering to a user's chest and shoulder regions.

Preferred embodiments of the invention are especially intended for use by women having large breasts (e.g., C cup and above). In order to comfortably support and contain large breast tissue mass, each cup preferably includes an underwire stiffener member located near its lower periphery.

Each cup in accordance with the invention can be formed of any suitable planar material such as spaced fabric plies sandwiching foam material therebetween or spaced silicone plies edge sealed to contain a silicone gel. The planar material preferably is somewhat stretchable to well conform to the shape of a user's breast. As is known in the art, the planar material can be formed by various known techniques including molding.

In typical use, a user will place her breast in the cup's cavity and then manipulate the cup while also pulling upwardly on the strap to position the cup and breast in a desired location and orientation. When properly positioned, the user will then smooth the cup and strap while adhering them against the user's skin in the chest and shoulder regions. The elongate strap is preferably sufficiently long, e.g. about 23 cm (9-10 inches), so as to provide ample adhesion surface area for adequately supporting a large breast tissue mass. The user can place the free end of the strap over the user's shoulder or, for a halter option, extend the strap behind the user's neck. By manipulating the position of the strap and cup, the user is able to adjust the breast lift as well as the spacing between the breasts to optimize comfort and appearance. The cup material is preferably slightly stretchable to conform to the breast shape and the strap material is preferably transparent to help conceal the strap.

DETAILED DESCRIPTION

Figure 1:
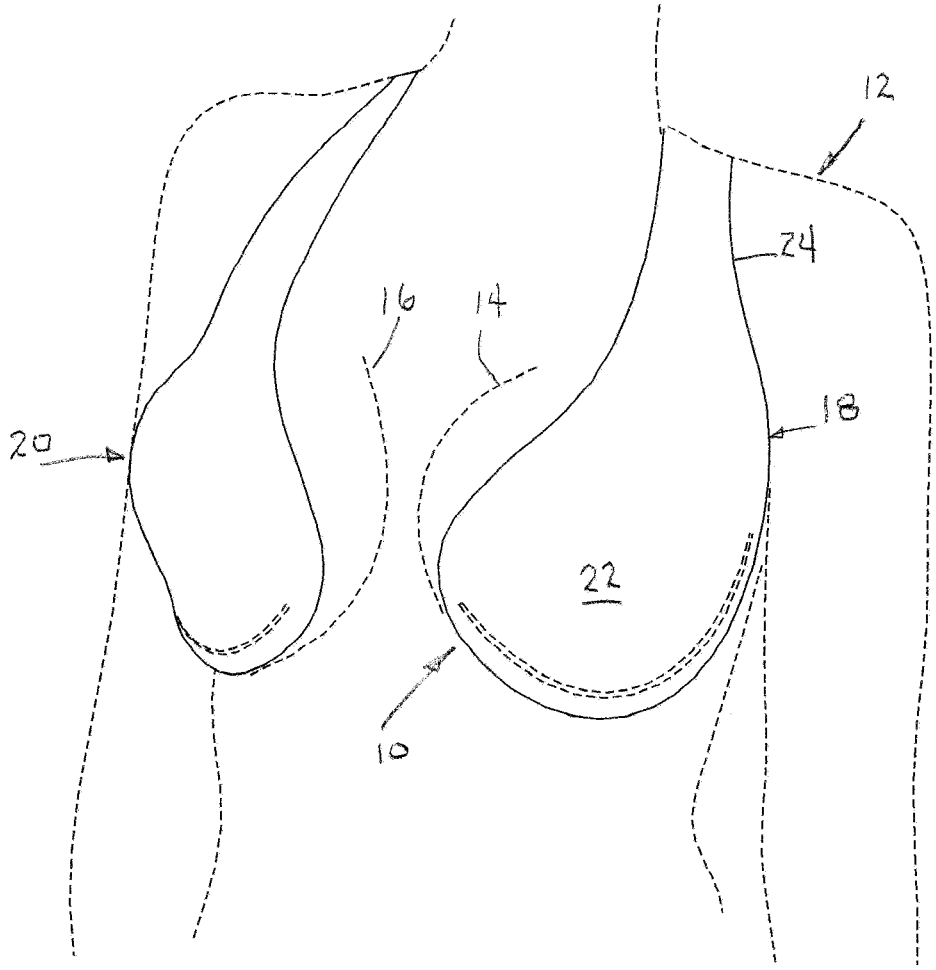
FIG. 1 is an illustrative view of an embodiment of the invention as worn by a model shown in phantom line.

Attention is initially directed to FIG. 1 which illustrates a preferred embodiment of a bra 10 in accordance with the present invention as worn by a model 12 having left and right breasts 14, 16. The bra 10 is characterized by separate left and right breast support members 18 and 20. Each breast support member includes a cup 22 for covering and supporting a breast and a thin elongate strap 24 configured for adhesion to a user's skin primarily in the chest and shoulder region.

Figure 2A:
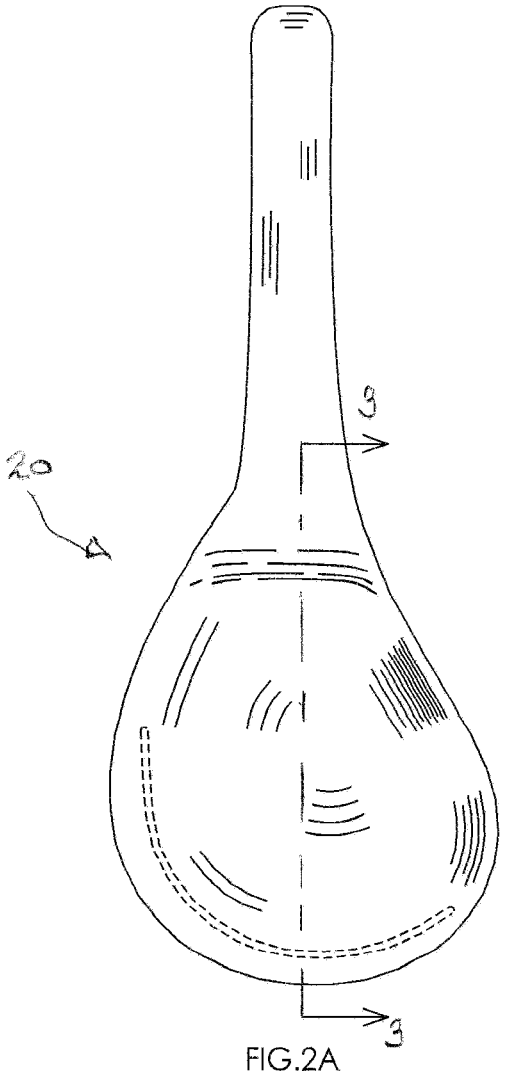
FIGS. 2A and 2B respectively depict front plan views of right and left breast support members in accordance with one preferred embodiment of the invention.
Figure 2B:
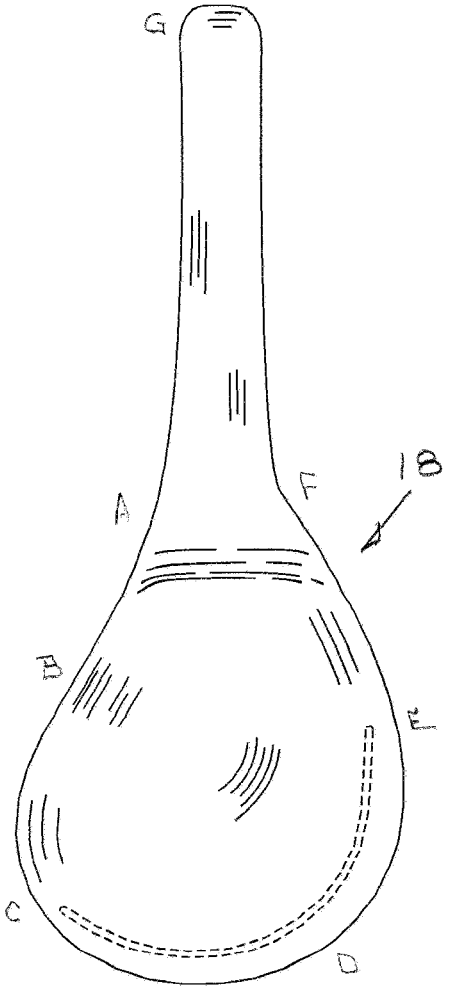
Figure 3:
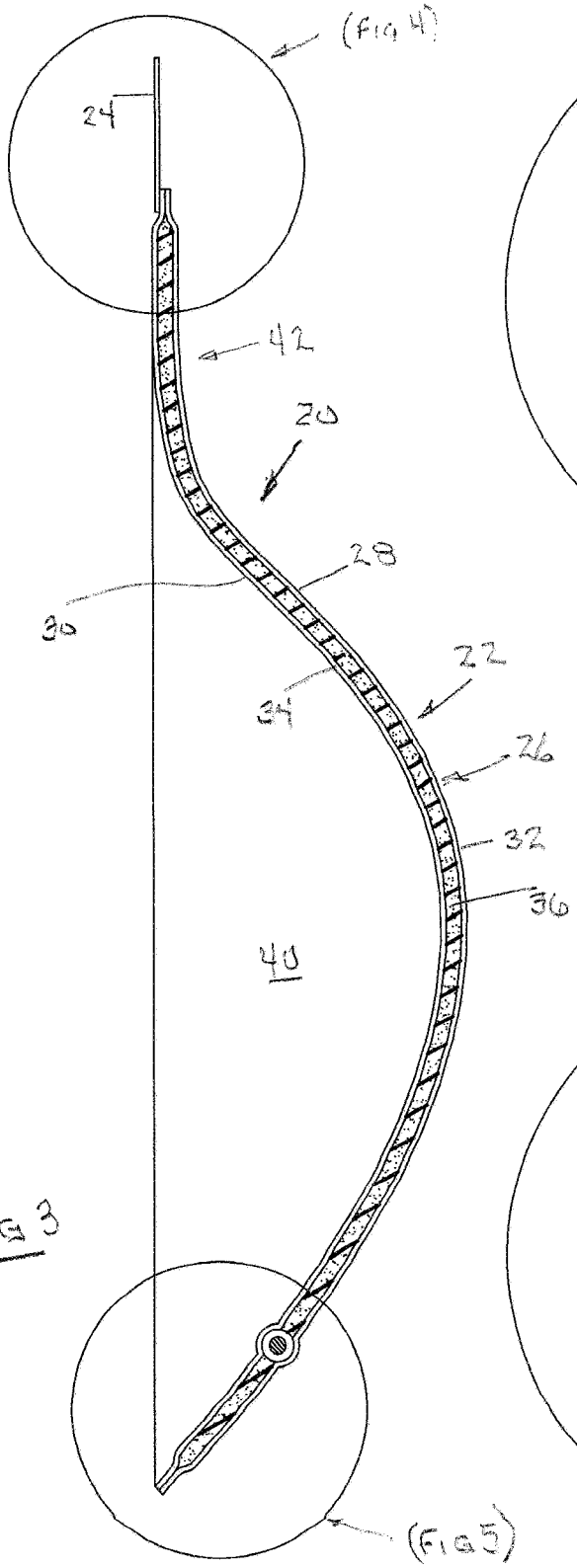
FIG. 3 is a sectional view taken substantially along the plane 3-3 shown in FIG. 2A.

FIGS. 2A and 2B respectively depict plan views of the right and left breast support members 18 and 20. Member 18 is the mirror image of member 20 but otherwise substantially identical. FIG. 3 shows the cross section of support member 20 which includes the cup 22 and strap 24. Cup 22 is formed by substantially planar material 26 having a front facing surface 28 and a rear facing surface 30. The material 26 depicted in FIG. 3 is comprised of a thin outer ply 32 carrying the front facing surface 28 and a thin inner ply 34 carrying the rear facing surface 30. The plies 32 and 34 sandwich a pliable material 36 therebetween. In one exemplary embodiment, the plies 32, 34 are fabric and accommodate foam sheet material 36 therebetween. In an alternative embodiment, the plies 32, 34 comprise silicone sheets sealed at their edges so as to contain a silicone gel material 36 therebetween. The material 26 preferably is somewhat stretchable to conform to the shape of a user's breast.

Cup 22 defines a concave cavity 40 extending into its rear facing surface 30. The planar material 26 can be formed to define the cup and cavity by techniques known in the art such as employing appropriate heat and pressure to shape/mold the cup.

Figure 5:
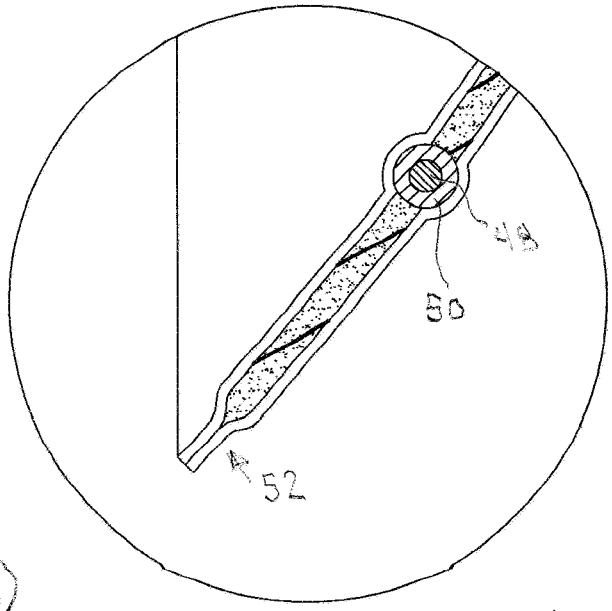
FIG. 5 is an enlarged detail view of the lower region of the breast support member cup of FIG. 3.

As seen in FIG. 3, the cup 22 is preferably shaped to define a relatively smooth curve extending from an upper cup region 42 to a rower cup region 44. In order to provide greater support and shaping, an elongate stiffener member 46 is preferably integrated into the cup 22 lower region 44 between the plies 32 and 34. The stiffener member 46 is preferably comprised of a plastic or metal wire 48 jacketed by a protective tube 50 and located above the lower peripheral edge 52 of the cup 22 as is best shown in FIG. 5.

Figure 4:
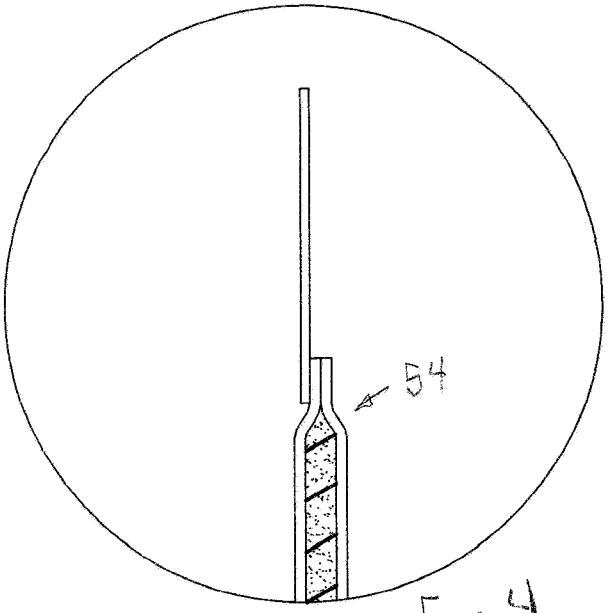
FIG. 4 is an enlarged detail view of the upper region of the breast support member cup of FIG. 3.

In accordance with a significant aspect of the present invention, the breast support member 20 includes a strap 24 extending upwardly from the upper peripheral edge 54 of cup 22, as shown in FIGS. 3 and 4. The strap 24 is comprised of thin flexible material, preferably being optically clear and transparent to assist in concealing the strap when worn with certain overgarments. The strap 24 can be fabricated integral with the cup 22 but more simply can be attached to the cup upper peripheral edge 54 by any of various technologies including welding, gluing, stitching, etc.

The support member rear facing surface 30 extending along both the cup 22 and strap 24 is coated with a reusable pressure sensitive adhesive (not shown). A protective removable plastic sheet (not shown) is provided in end user products for temporarily covering the adhesive to facilitate handling.

In order to optimally wear the bra of the present invention, a user is advised as follows:

How to Apply the Bra:

1. Gently peel the protective sheet from the adhesive covering the cup rear facing surface. Preferably the protective sheet should be saved for bra storage.
2. Lift the breast from the side and begin sticking the cup to the breast from the outside edge making sure the stiffener member is underneath the breast.
3. Stretch and pull the cup to laterally and vertically position the breast while smoothing the cup material against the breast.
4. Pull the strap to optimally position the breast while smoothing and adhering the strap against a desired area of the chest and shoulder (or for a halter option, adhering the strap behind the neck).

To Remove the Bra:

Gently peel the cup and strap from the skin. If any adhesive residue exists on the skin, use baby oil to remove.

After use, replace the protective sheet onto the adhesive surfaces of the cup and strap.

In order to accommodate a wide range of breast sizes, it is intended to provide embodiments of the invention in multiple cup sizes. With reference to the approximate points A-G designated in FIG. 2B, the following table lists exemplary dimensions in centimeters (cm) for cup sizes C, D, DD, DDD, G, H:

| | C | D | DD | DDD | G | H |
|---|---|---|---|---|---|---|
| B-D | 18.5 | 19.7 | 20.9 | 22.1 | 23.3 | 24.5 |
| A-C | 15.5 | 16.7 | 17.9 | 19.1 | 20.3 | 21.5 |
| E-F | 9.5 | 10.5 | 11.5 | 12.5 | 13.5 | 14.5 |
| C-E | 24.5 | 25.8 | 27.1 | 28.4 | 29.7 | 31 |
| A-F | 5.1 | 5.1 | 5.1 | 5.1 | 5.1 | 5.1 |
| A-G | 23 | 23 | 23 | 23 | 23 | 23 |

From the foregoing, it should now be clear that the invention comprises an adhesive bra particularly suited for large breasted women, typically for use with plunge and/or backless overgarments. Embodiments of the invention are characterized by separate left and right breast support members, each member being comprised of a cup portion and a vertically extending strap for providing increased support. Although particular embodiments have been described herein citing suitable materials and dimensions, it should be recognized that these are exemplary only and are not intended to limit the scope of the invention which is defined by the appended claims.

What is claimed is:

1. A bra especially configured for use with backless and/or plunge neckline overgarments, said bra comprising separate left and right breast support members:

said left breast support member comprising a section of substantially planar material having a front facing surface and a rear facing surface formed to define a cup comprising a cavity in said rear facing surface for accommodating a wearer's left breast; said cup having a lower cup region for placement under a wearer's left breast and an upper cup region spaced vertically above said lower cup region and wherein said cup rear facing surface carries pressure sensitive adhesive for adhering to a wearer's breast; a strap having a lower end extending from said upper cup region and of sufficient length to allow an upper free end to contact a wearer's shoulder; said strap having a front facing surface and a rear facing surface; and wherein said strap rear facing surface carries a pressure sensitive adhesive for adhering to a wearer's shoulder for vertically supporting said cup and the wearer's breast therein; and said right breast support member comprising a section of substantially planar material having a front facing surface and a rear facing surface formed to define a cup comprising a cavity in said rear facing surface for accommodating a wearer's right breast; said cup having a lower cup region for placement under a wearer's right breast and an upper cup region spaced vertically above said lower cup region and wherein said cup rear facing surface carries pressure sensitive adhesive for adhering to a wearer's breast; a strap having a lower end extending from said upper cup region and of sufficient length to allow an upper free end to contact a wearer's shoulder; said strap having a front facing surface and a rear facing surface; and wherein said strap rear facing surface carries a pressure sensitive adhesive for adhering to a wearer's shoulder for vertically supporting said cup and the wearers breast therein.

2. The bra of claim 1 further including:

an elongate left stiffener member mounted in said left breast support member lower cup region; and an elongate right stiffener member mounted in said right breast support member lower cup region.

3. The bra of claim 1 wherein:

said left breast support member planar material comprises foam sheet material sandwiched between outer and inner flexible plies.

4. The bra of claim 1 wherein:

said left breast support member planar material comprises inner and outer silicone sheets containing a silicone gel therebetween.

5. A bra especially configured for use with a backless and/or plunge neckline overgarment, said bra comprising separate left and right breast support members, each support member comprising:

a breast cup having a front facing surface and a rear facing surface;

said cup defining a cavity in said rear facing surface configured to accommodate a wearer's breast and a periphery including a lower region for placement under a wearer's breast and an upper region spaced vertically above said lower region;

a flexible strap having a first end attached to said cup upper region, said strap having sufficient length to allow a second end to reach a wearer's shoulder, said strap having front and rear facing surfaces; and wherein said cup and strap rear facing surfaces carry a pressure sensitive adhesive for adhering to the breast, chest, and shoulder regions of a wearer's skin for vertically supporting said cup and the wearer's breast therein.

6. The bra of claim 5 further including:

a stiffener member mounted in said cup lower region.

7. The bra of claim 5 wherein:

said breast cup is formed of foam sheet material sandwiched between outer and inner flexible plies.

8. The bra of claim 5 wherein:

said breast cup is formed of inner and outer silicone sheet material containing a silicone gel therebetween.

9. A method of supporting a user's breast, said method comprising:

providing left and right breast support members, each comprising a section of planar material forming a cup having a front facing surface and a rear facing surface and wherein said cup includes a lower region for placement under a user's breast and an upper region displaced vertically from said lower region, and a strap having a first end attached to said cup upper region and a second free end spaced a sufficient distance from said first end for contacting a user's shoulder, said strap having a front facing surface and a rear facing surface;

placing the user's breast in said cup with said strap extending vertically from said cup upper region to locate said strap second end over the user's shoulder;

manipulating said cup to laterally position the user's breast;

manipulating said strap to vertically position said cup and breast therein; and adhering the rear facing surface of said cup against the user's breast and the rear facing surface of said strap against the user's shoulder for vertically supporting the cup and the user's breast therein.

* * * * *